US005655261A

United States Patent [19]

Cress

[11] Patent Number: 5,655,261

[45] Date of Patent: Aug. 12, 1997

[54] CLOSING MECHANISM FOR CABINET HINGE

[75] Inventor: David R. Cress, Janesville, Wis.

[73] Assignee: Newell Operating Company, Freeport, Ill.

[21] Appl. No.: 718,963

[22] Filed: Sep. 26, 1996

[51] Int. Cl.[6] ..... E05F 1/08

[52] U.S. Cl. ..... 16/286; 16/296; 16/304; 16/335

[58] Field of Search ..... 16/286, 296, 297, 16/303, 304, 305, 325, 334, 344, 333, 335

[56] References Cited

U.S. PATENT DOCUMENTS

| | | | |
|---|---|---|---|
| 3,391,420 | 7/1968 | Anderson . | |
| 3,835,585 | 9/1974 | Anderson et al. . | |
| 3,851,354 | 12/1974 | Anderson . | |
| 3,908,228 | 9/1975 | Newcomer | 16/286 |
| 4,177,540 | 12/1979 | Gorton . | |
| 4,352,222 | 10/1982 | Mages et al. | 16/304 |
| 4,439,888 | 4/1984 | Merillat . | |
| 4,654,930 | 4/1987 | Lautenschlager, Jr. et al. | 16/296 |
| 4,987,640 | 1/1991 | Lin . | |
| 5,355,557 | 10/1994 | Cress et al. | 16/286 |
| 5,392,493 | 2/1995 | Youngdale | 16/335 |

OTHER PUBLICATIONS

Drawing—5 Sheets (FIGS 1–20), showing various embodiments of a Prototype Hinge developed by David R. Cress, and shown to prospective customers on or about Jan., 1990.

*Primary Examiner*—Chuck Y. Mah
*Attorney, Agent, or Firm*—Foley & Lardner

[57] ABSTRACT

A self-closing mechanism for a fully concealed hinge, which has a hinge cup for mounting on a door, and a frame wing pivotally supported thereon for attachment to a frame on which the door is mounted. The mechanism includes a combination compression coil spring retainer and plunger which is mounted on the frame wing, and positioned to be pressed against cam surfaces provided on the hinge cup. The cam surfaces are formed such that force applied to the cam surfaces by the plunger will act to maintain the door in open and closed positions, will apply a force to close the door when approaching the closed position, and otherwise will not exert either an opening or a closing force on the door.

24 Claims, 3 Drawing Sheets

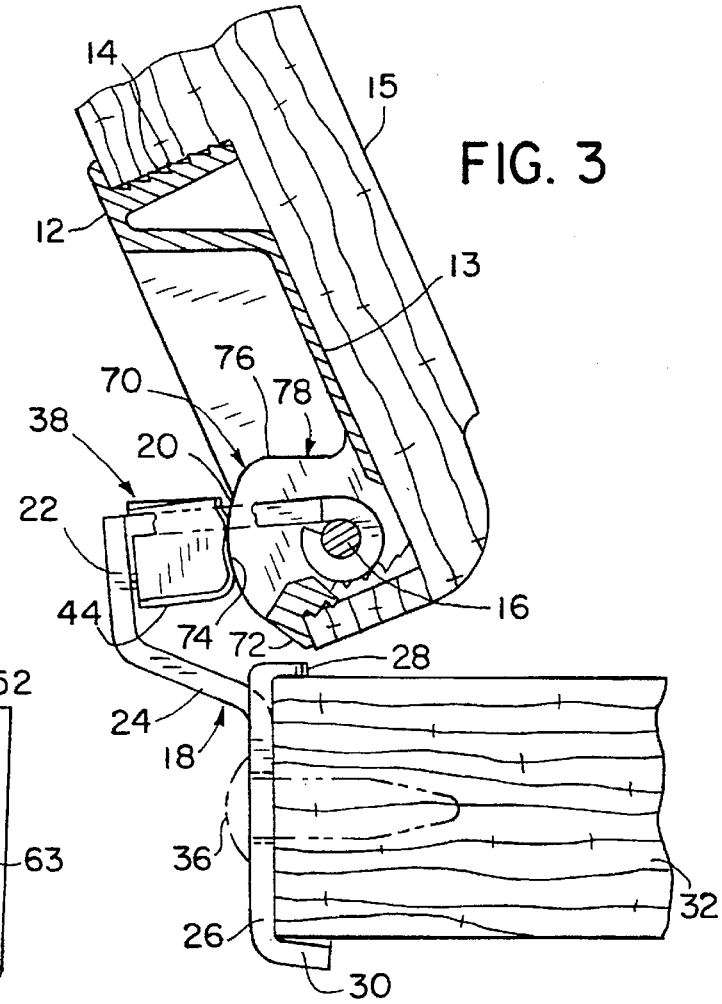
FIG. 3
FIG. 6
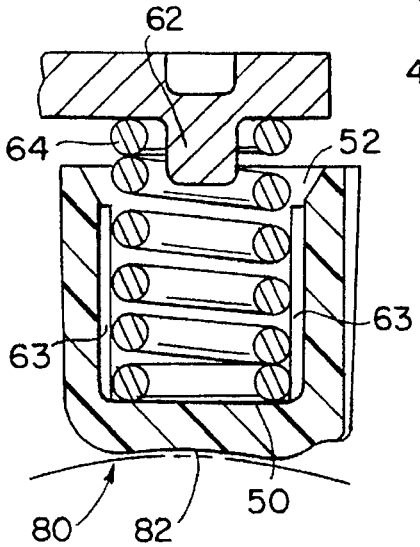
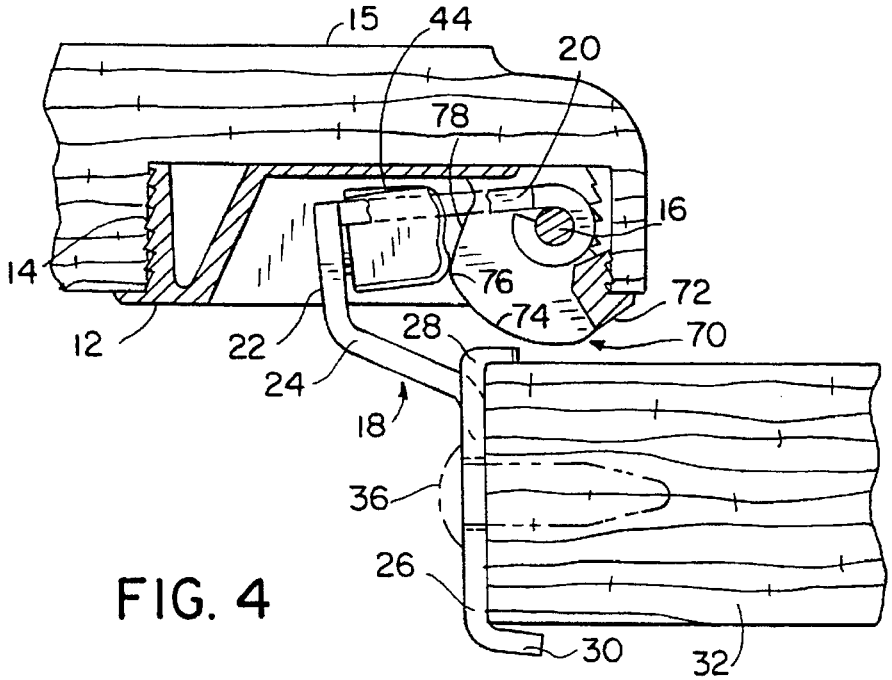
FIG. 4

FIG. 7
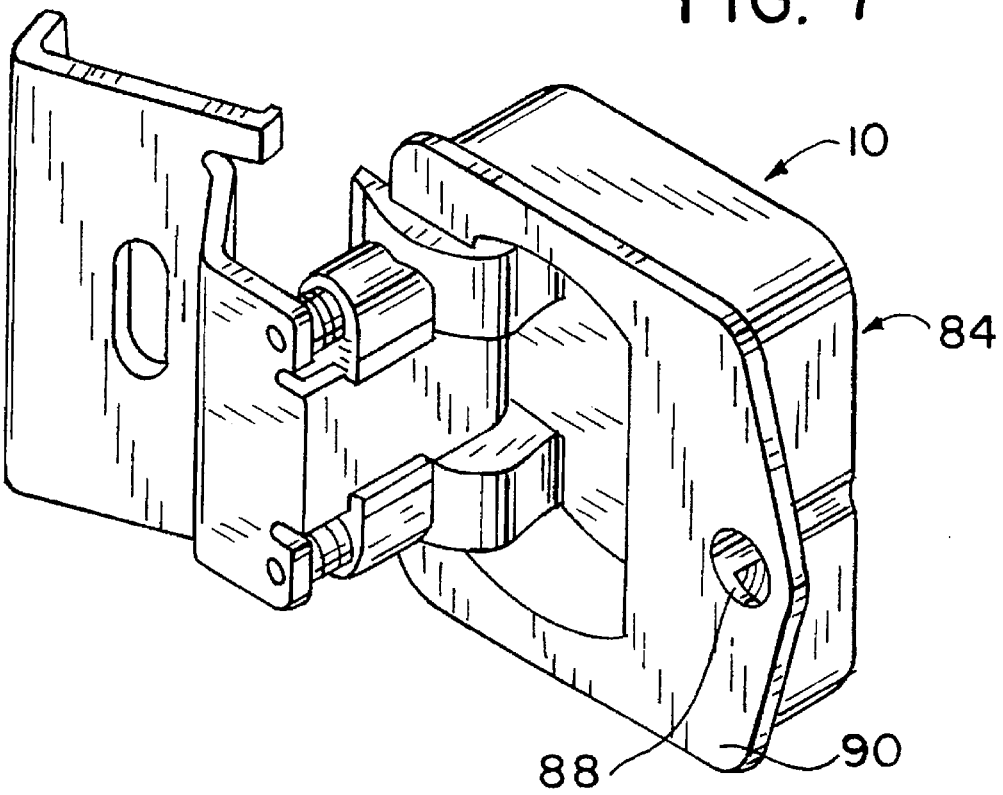
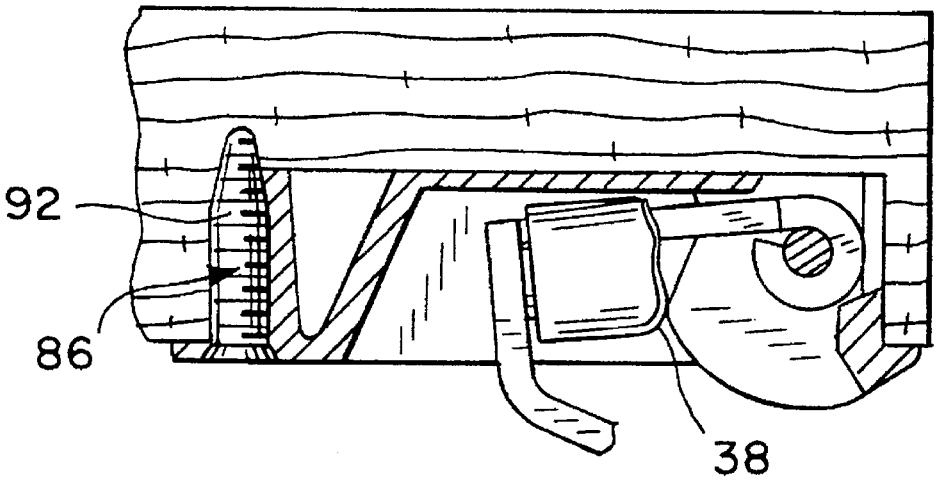
FIG. 8

CLOSING MECHANISM FOR CABINET HINGE

FIELD OF THE INVENTION

The present invention relates to a cabinet hinge used to mount a cabinet door to a frame. Specifically, the present invention relates to a fully concealed cabinet hinge having a mounting cup which is received in a bore in a cabinet door, and to which is pivotally attached a frame mounting member which is mounted to the cabinet frame. More specifically, the present invention relates to a compact self-closing mechanism, the active components of which are carried by the frame mounting member, and disposed in the mounting cup when the hinged cabinet door is closed.

BACKGROUND OF THE INVENTION

Self closing cabinet door hinges have been provided in the past. U.S. Pat. No. 3,391,420 entitled "Hinge", issued to L. L. Anderson on Jul. 9, 1968, discloses such a hinge. In the self-closing hinge disclosed in the Anderson patent the active components of the self closing mechanism, which are carried by the frame mounted member, apply a closing force to a small radius portion of the door mounted member which is curled around a pivot pin carried by the frame mounted member. Therefor, the closing force being applied to the small radius portion of the door mounted member, is applied with a short moment arm. Thus, the torque resulting from the closing force developed by the self-closing mechanism is not as great as it would be, if the closing force were applied with a longer moment arm.

Accordingly, it would be advantageous to provide a fully concealed cabinet hinge, with a self-closing mechanism, which has increased closing torque, without increasing the diameter or depth of the mounting cup. It would also be advantageous to provide the increased closing torque without increasing the complexity and therefore both the material and assembly costs of the cabinet hinge.

SUMMARY OF THE INVENTION

It is an object of this invention to provide a fully concealed, self-closing cabinet hinge of the type having a mounting cup secured in a recess in a cabinet door with a frame mounting member pivotally secured thereto, which has increased self-closing torque without increasing the diameter or depth of the mounting cup. It is a further object of this invention to provide increased self-closing torque in a fully concealed self-closing cabinet hinge without increasing the complexity and therefore both the material and assembly cost of the hinge.

In accordance with this invention a fully concealed self-closing cabinet hinge having a mounting cup secured in a recess in a cabinet door and a frame mounting member pivotally supported on a pivot pin carried by the hinge cup or door mounting member is provided, which has a greater self-closing torque than has been provide by previously available hinges of comparable size. A pair of cam surfaces are provided on the mounting cup at each end of the pivot pin. The cam surfaces, which are engaged by a force generating assembly carried by the frame mounting member, have two or more distinct cam portions.

The force generating assembly includes a plunger which is slidingly retained on a portion of the frame mounting member. Sockets, having one closed, end are formed in the plunger for retaining or holding springs which provide a compressive force between the frame mounting member and the cam surfaces. The outer surfaces of the portions of the plunger forming the closed ends of the sockets engages the cam surfaces.

The outer surfaces of the plunger which bear against the cam surfaces are curved with a radius to match a fixed radius curve of a first portion of the cam surface. When the plunger surface engages the first portion of the cam, the door is between the fully open position and approaching the closed position. A second portion of the cam surface is a curved continuation of the first fixed radius curved cam portion. The second curved portion has a changing radius which becomes shorter as it continues away from the first portion. The engagement of the plunger surface with this second portion results in a closing torque being applied to the door. The continued engagement of the plunger surface with the second portion of the cam surface provides a torque to hold the door in the closed position. The cam surface may be provided with a third portion which is a flat continuation of the other end of the first fixed radius portion. This third flat surface is engaged by the plunger surface when the door is in the fully open position, so as to hold the door in the fully open position.

The self-closing mechanism of this invention may be added to a currently manufactured fully concealed cabinet hinge having a mounting cup, and not having a self closing mechanism, without increasing either the diameter or the depth of the mounting cup of the fully concealed hinge.

BRIEF DESCRIPTION OF THE DRAWINGS

FIG. 3 is a side cross-sectional view of the hinge shown in FIG. 1, mounted on a door and a frame, with the door in an intermediate position between the fully open position and the fully closed;

FIG. 4 is a side cross-sectional view of the hinge shown in FIG. 1, mounted on a door and a frame, with the door in the fully closed position;

FIG. 6 is an enlarged cross-sectional view of the force providing assembly of the self-closing mechanism of the hinge shown in FIG. 1, taken along the line 6—6 in FIG. 5;

FIG. 7 is a perspective view of an alternate embodiment of a fully concealed hinge having a self-closing mechanism in accordance with this invention; and FIG. 8 is a side cross-sectional view of the hinge shown in FIG. 7, mounted on a door, with the door in the fully closed position.

DETAILED DESCRIPTION OF THE PREFERRED EMBODIMENT

Figure 1:
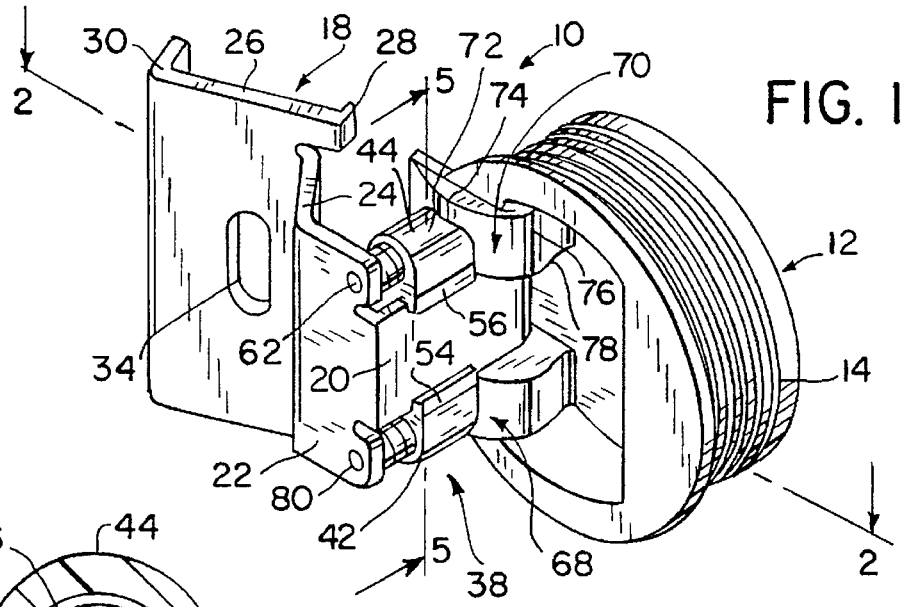
FIG. 1 is a perspective view of a fully concealed hinge having a self-closing mechanism in accordance with a preferred embodiment of this invention.
Figure 5:
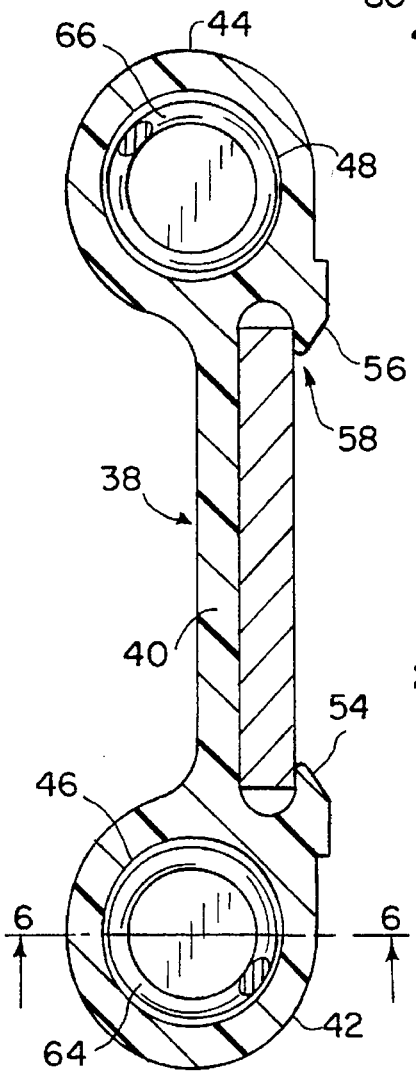
FIG. 5 is an enlarged cross-sectional view of the force providing assembly of the self-closing mechanism of the hinge shown in FIG. 1, taken along the line 5—5 in FIG. 1.

Referring to FIG. 1, a fully concealed cabinet hinge having a self-closing mechanism in accordance with this invention will be described. A cabinet hinge 10 is provided with a door mounting member or cup 12 which is received in a bore 13 provided in the rear surface of a cabinet door 15 to be pivotally supported by the hinge. The outer circumference of the cup 12 is provided with ribs or threads 14 which fictionally engage the sidewall of the bore 13 in the door 15 to retain the cup 12 therein.

Figure 2:
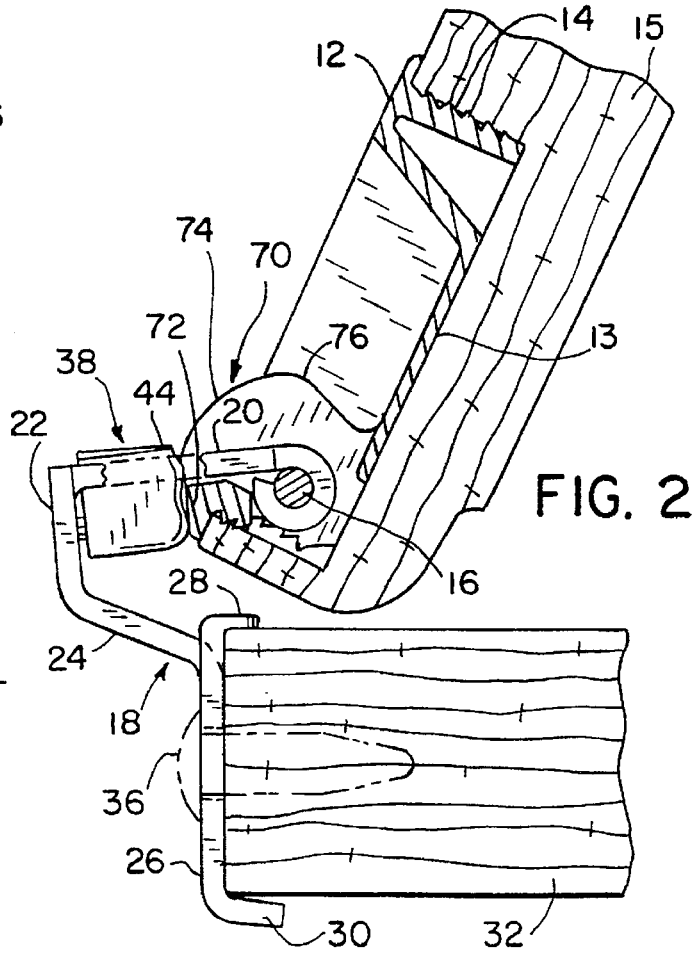
FIG. 2 is a side cross-sectional view of the hinge shown in FIG. 1, mounted on a door and a frame, with the door in the fully open position.

Referring to FIG. 2, the exposed end of the cup 12 is provided with a recess, in which is supported a hinge or pivot pin 16 for supporting a frame mounting member 18. The frame mounting member has a first portion 20, one end of which is curled around the pivot pin 16. A second portion 22 of the frame mounting member extends at right angles to the other end of the first portion 20. A third portion 24 extends from the second portion 22 in the same general direction as the first portion 20, but at an angle to the first portion 20. A fourth portion 26, extending from the third portion 24, is essentially perpendicular to the first portion 20. Tabs 28 and a fifth portion 30 which extend in the same direction from opposite ends of fourth portion 26, are provided to engage opposite sides of a cabinet frame 32 from which the door is to be supported, with the fourth portion 26 engaging the edge of the cabinet frame 32. The relative angular positions of portions 22, 24, and 26 with respect to each other may be changed, depending upon the desired amount by which the door 15, is to overlap the front surface of the cabinet frame 32 when the door 15 is closed. For instance, portions 22, 24, and 26 may be formed in alignment with each other.

As shown in FIG. 1, an elongated slot 34 is formed in fourth portion or frame wing 26, for receiving a screw 36 (shown by phantom lines in FIG. 2) for securing the frame wing to the frame 32. The elongated slot permits adjustment of the position of the door with respect to the frame 32.

Referring particularly to FIGS. 1, 2, 5 and 6, the self-closing mechanism of this invention will be described. The self-closing mechanism includes a spring retainer or plunger 38, which is preferably formed of a compliant or resilient, durable, wear resistant, and low friction plastic polymer (e,g. acetal, "DELRIN", or the like). The plunger 38 is formed with an elongated thin central section 40 having at its ends enlarged cylindrical portions 42 and 44, which are provided with cylindrical bores 46 and 48 respectively. As shown in FIG. 6, the bores 46 and 48 have closed ends 50 and open ends 52 so as to form closed end sockets. A pair of tabs 54 and 56 extend from the cylindrical portions 42 and 44 respectively and are spaced from the central section 40 to form a slot 58 for receiving the first portion 20 of the frame mounting member 18. The central section 40 of the plunger 38 is bent to permit the first portion 20 of the frame mounting member 18 to be inserted into the slot 58, and thereafter held therein in a snap fit. The slot 58 is slightly larger in cross-section than the first portion 20, such that the first portion 20 may move within the slot 58.

A pair of spring holding projections 60 and 62, extending toward and in alignment with the bores 46 and 48, are formed in the second portion 22 of the frame mounting member 18. In a preferred construction, the spring holding posts 60 and 62 are formed integrally with the frame mounting member 18 by a stamping operation. Coil springs 64 and 66 are placed in the sockets formed by the bores 46 and 48 respectively, engaging at one end the closed ends 50 of the bores and surrounding at the other end the posts 60 and 62 respectively. The coil springs are placed in the bores 46 and 48 before the plunger 38 is secured to the frame mounting member 18. The springs 64 and 66 are held in the bores 46 and 48 during assembly by ribs or flats 63 provided on the walls of the bores.

The closed ends 50 of the plunger 38 engage a pair of cam surfaces 68 and 70 formed in the exposed open end of the cup 12 at each end of the pivot pin 16. Each of the cam surfaces has a flat portion 72 corresponding the open position of the door, a curved portion 74 corresponding to positions of the door between open and closed, a portion 76 of decreasing radius extending from curved portion 74 corresponding to the almost closed and closed positions of the door, and a flat portion 78 extending from portion 76. The outer surfaces 80 of the closed ends 50 of the plunger are provided with curved surfaces 82 which have a radius corresponding to that of the curved portions 74 of the cam surfaces 68 and 70.

Referring now to FIGS. 2, 3, and 4 the operation of the self-closing mechanism of this invention will be described. In FIG. 2 the door is shown in the fully open position, with portions of the outer surfaces 80 of the closed ends 50 of the plunger engaging flat portions 72 of the cam surfaces 68 and 70. The forces of the springs 64 and 66 applied to the flat portions 72 of the cam surfaces 68 and 70 by the plunger 38 act to hold the door in the open position.

As an external force is applied to the door to pivot it toward the closed position, the curved surfaces 82 of the plunger will engage the curved portions 74 of the cam surfaces 68 and 70 as shown in FIG. 3. Since the forces of the spring 64 and 66 are applied radially to the curved portions 74 of the cam surfaces 68, they will apply neither an opening or a closing force to the door. Rather, the forces of the springs 64 and 66 will only result in somewhat increased frictional forces between the curved surfaces 82 of the plunger and the curved portions 74 of the cam surfaces 68, which will tend to resist an external force applied to the door in either the opening or closing direction.

As the door approaches the closed position as shown in FIG. 4, the curved surfaces 82 of the plunger will engaging the portions 76 of decreasing radius of the cam surfaces 68. The forces of the springs 64 and 66 will cause the curved surfaces 82 of the plunger 38, to move along the portions 76 of the cam surface 68 in the direction of its decreasing radius, thereby urging the door to the closed position as shown in FIG. 4. As shown in FIG. 4, movement of the plunger 38 along the cam surface 68 toward the flat portion 78 extending from portion 74, is in the direction of further decrease in the radius of the cam surface 68. Therefor, the forces of the springs 64 and 66 act to hold the door in the closed position as shown in FIG. 4.

A self-closing mechanism of this invention may be applied to fully concealed cabinet hinges which are secured to the door by various mechanisms. Referring to FIGS. 7 and 8, the self-closing mechanism of this invention is applied to a fully concealed cabinet hinge which is provided with a rectangular cup 84, which is secured in a rectangular bore in the door by a screw 86 which passes through a hole 88 in a flange 90 provided on the cup 84. The thread 92 of the screw 86 engage the side wall of the cup 84 and the adjacent edge of the rectangular bore in the door. The self-closing mechanism of this invention may be applied to fully concealed cabinet hinges which are secured to the door by still other arrangements, such as one using more than one screw.

While only one embodiment of the invention has been shown, it should be apparent to those skilled in the art that what has been described is considered at present to be a preferred embodiment of the self-closing mechanism for a fully concealed hinge of this invention. Changes may be made in the self-closing mechanism without actually departing from the true spirit and scope of this invention. The appended claims are intended to cover all such changes and modification which fall in the true spirit and scope of this invention.

What is claimed is:

1. A self-closing mechanism for a fully concealed hinge, which has a hinge cup for mounting in a bore in a door, and a frame wing pivotally supported by the hinge cup for mounting on the door frame, said self-closing mechanism comprising:

at least one cam surface on the hinge cup, said cam surface having at least three portions, a first portion corresponding to a fully open position of said door, a second portion corresponding to an almost closed and closed position of said door, and a third intermediate portion, between said first and second portions, corresponding to a position of said door between fully open and almost closed positions, a force generating assembly movably secured to the frame wing, said force generating assembly including a housing, and at least one spring retained by said housing, said at least one spring exerting a compressive force between said frame wing and said cam surface, whereby the compressive force when applied to said first portion results in a torque retaining the door in the fully open position, when applied to said second portion results in a torque for closing and retaining the door in the closed position, and when applied to said third portion does not apply a torque to the door.

2. The self-closing mechanism for a fully concealed hinge of claim 1, wherein said housing includes a socket for retaining said at least one spring.

3. The self-closing mechanism for a fully concealed hinge of claim 1, wherein said at least one spring is a coil spring.

4. The self-closing mechanism for a fully concealed hinge of claim 1, wherein said housing includes at least one socket, and said at least one spring is retained in said at least one socket.

5. The self-closing mechanism for a fully concealed hinge of claim 4, wherein said at least one socket has a surface which engages said at least one cam surface on the hinge cup.

6. The self-closing mechanism for a fully concealed hinge of claim 1, wherein said housing includes two sockets, and a spring is retained in each of said sockets.

7. The self-closing mechanism for a fully concealed hinge of claim 1, wherein said hinge cup is provided with a hinge pin, and said frame wing is pivotally support by said hinge pin.

8. The self-closing mechanism for a fully concealed hinge of claim 7, wherein two cam surfaces are provided on the hinge cup, located at opposite ends of said hinge pin.

9. The self-closing mechanism for a fully concealed hinge of claim 8, wherein said housing includes two sockets located on opposite ends of said hinge pin, and a spring is retained in each of said sockets.

10. The self-closing mechanism for a fully concealed hinge of claim 1, wherein said frame wing is formed to provide a portion engaged by one end of said at least one spring, with said other end of said spring exerting a compressive force on said cam surface.

11. The self-closing mechanism for a fully concealed hinge of claim 10, wherein said portion of said frame wing is provided with at least one spring holding projection for holding said one end of said at least one spring.

12. The self-closing mechanism for a fully concealed hinge of claim 1, wherein said housing is formed of a plastic material.

13. A self-closing mechanism for a fully concealed hinge, which has a hinge cup for mounting in a bore in a door, and a frame wing pivotally supported by the hinge cup for mounting on the door frame, said self-closing mechanism comprising:

at least one cam surface on the hinge cup, said cam surface having at least two distinct portions, a first portion corresponding to an almost closed and closed position of said door, and a second portion, corresponding to a position of said door between a fully open and an almost closed position, a force generating assembly movably secured to the frame wing, said force generating assembly including a housing, and at least one spring retained by said housing, said at least one spring exerting a compressive force between said frame wing and said at least one cam surface, whereby the compressive force when applied to said first portion results in a torque for closing and retaining the door in the closed position, and when applied to said second portion does not apply a torque to the door.

14. The self-closing mechanism for a fully concealed hinge of claim 13, wherein said housing includes a socket for retaining said at least one spring.

15. The self-closing mechanism for a fully concealed hinge of claim 13, wherein said at least one spring is a coil spring.

16. The self-closing mechanism for a fully concealed hinge of claim 13, wherein said housing includes at least one socket, and said at least one spring is retained in said at least one socket.

17. The self-closing mechanism for a fully concealed hinge of claim 16, wherein said at least one socket has a surface which engages said at least one cam surface on the hinge cup.

18. The self-closing mechanism for a fully concealed hinge of claim 13, wherein said housing includes two sockets, and a spring is retained in each of said sockets.

19. The self-closing mechanism for a fully concealed hinge of claim 13, wherein said hinge cup is provided with a hinge pin, and said frame wing is pivotally support by said hinge pin.

20. The self-closing mechanism for a fully concealed hinge of claim 19, wherein two cam surfaces are provided on the hinge cup, located at opposite ends of said hinge pin.

21. The self-closing mechanism for a fully concealed hinge of claim 20, wherein said housing includes two sockets located on opposite ends of said hinge pin, and a spring is retained in each of said sockets.

22. The self-closing mechanism for a fully concealed hinge of claim 13, wherein said frame wing is formed to provide a portion engaged by one end of said at least one spring, with said other end of said spring exerting a compressive force on said cam surface.

23. The self-closing mechanism for a fully concealed hinge of claim 22, wherein said portion of said frame wing is provided with at least one spring holding projection for holding said one end of said at least one spring.

24. The self-closing mechanism for a fully concealed hinge of claim 13, wherein said housing is formed of a plastic material.

* * * * *